US008136200B2

(12) United States Patent
Splinter

(10) Patent No.: US 8,136,200 B2
(45) Date of Patent: Mar. 20, 2012

(54) ROBOTIC CLEANING HEAD

(75) Inventor: Alexander Poul Splinter, Leiden (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 419 days.

(21) Appl. No.: 12/523,165

(22) PCT Filed: Jan. 16, 2008

(86) PCT No.: PCT/IB2008/050140

§ 371 (c)(1),
(2), (4) Date: Jul. 15, 2009

(87) PCT Pub. No.: WO2008/090490

PCT Pub. Date: Jul. 31, 2008

(65) Prior Publication Data

US 2010/0050366 A1 Mar. 4, 2010

(30) Foreign Application Priority Data

Jan. 22, 2007 (EP) ..... 07100907

(51) Int. Cl.
*A47L 5/00* (2006.01)
*A47L 9/00* (2006.01)

(52) U.S. Cl. ..... 15/319; 15/339; 15/340.1

(58) Field of Classification Search ..... 15/319, 15/339, 340.1; *A47L 5/00, 9/00*
See application file for complete search history.

(56) References Cited

U.S. PATENT DOCUMENTS

2005/0055792 A1 3/2005 Kisela et al.

FOREIGN PATENT DOCUMENTS

| | | | |
|---|---|---|---|
| DE | 10064836 | A1 | 6/2002 |
| EP | 1360922 | A2 | 11/2003 |
| JP | 2004236733 | A1 | 8/2004 |
| WO | 9908584 | A1 | 2/1999 |
| WO | 02074150 | A1 | 9/2002 |
| WO | 2007117095 | A1 | 10/2007 |

*Primary Examiner* — David Redding

(57) ABSTRACT

A robotic cleaning head (1; 101) for use as part of an autonomous vacuum cleaning system (2) including a canister unit (3) and a hose assembly (4; 104) connecting the cleaning head (1; 101) to the canister unit (3). The cleaning head (3) has a chassis (5; 105), a drive system (6; 18; 27), a vacuum cleaning nozzle (8; 108) and a conduit (9; 109). The conduit (9; 109) communicates with an air passage bound by the cleaning nozzle (8; 108). It is suspended pivotable about a pivot axis (10; 110) and includes an inlet (11; 111) provided on top of said chassis (5; 105), and an elbow section (12; 112) downstream of the inlet (11; 111), and the conduit (9; 109) is suspended and shaped such that a line of action (15; 115) of a tension force (20; 120) exerted by the hose assembly (4; 104) onto the chassis (5; 105), via the conduit (9; 109) to which the hose assembly (4; 104) is connected, extends spaced below a downstream end of the elbow section (12; 112).

12 Claims, 3 Drawing Sheets

ROBOTIC CLEANING HEAD

FIELD OF THE INVENTION

The invention relates to a robotic cleaning head for use as part of an autonomous vacuum cleaning system further including a canister unit and a hose assembly connecting the cleaning head to the canister unit.

BACKGROUND OF THE INVENTION

Such a robotic cleaning head is disclosed in European patent application 1 360 922. The canister unit holds a fan, a motor for driving the fan, dust filters and a dust collection chamber. Thus, the cleaning head can have relatively small dimensions, which is advantageous for agility and for reaching encumbered areas, for example, under furniture and in corners. For the maneuverability of the cleaning head, it is advantageous that the hose connects to a conduit of the cleaning head which is pivotable about a pivot axis and that the conduit includes an elbow section downstream of an inlet of the conduit extending coaxially with the pivot axis.

In operation, the hose assembly exerts forces on both the cleaning head and the canister unit due to friction over the floor and reaction forces in response to flexing of the hose. These forces impair the maneuverability of the cleaning head. For example, when the cleaning head drives forward it drags along at least an adjacent portion of the hose and the forces exerted by the hose are most of the time oriented at an angle to the intended direction of displacement of the cleaning head and affect the actual direction of displacement of the cleaning head. This results in a less accurate control over the path of travel and hence a less effective cleaning result and/or a slower progress over the floor surface. Moreover, diversions from the path of travel increase the risk of bumping into objects.

SUMMARY OF THE INVENTION

It is an object of the invention to provide a cleaning head of which the maneuverability is less sensitive to forces exerted upon it by the hose to which it is connected.

According to the present invention, this object is achieved by providing a robotic cleaning head according to claim 1.

Because the conduit is suspended and shaped such that, in operating condition, a line of action of a tension force exerted by the hose assembly onto the chassis via the conduit to which the hose assembly is connected, extends below a downstream end of the elbow section, the tilting moment resulting from the force exerted upon the cleaning head by the hose and the friction forces between the floor and the cleaning head is relatively small. Accordingly, the tilting moment exerted on the cleaning head at given forces exerted by the hose is substantially reduced. Therefore, there is less reduction of contact pressure between the drive system and the floor on one side of the drive system. Such a reduction of the contact pressure between the drive system and the floor on one side of the drive system allows the drive system to slip more easily over the floor on that side, thereby adversely affecting the steering accuracy.

The conduit may include a boom section extending from the elbow section radially relative to the pivot axis and an outlet end section downstream of the boom section and at least partially extending horizontally outside of the chassis and the drive system and downwardly from the boom section, such that, when in operating condition, a lowermost portion of the outlet end portion is at a level below an uppermost portion of at least the chassis, the drive system or the nozzle. By means of these features, the lowering of the line of action along which the tension forces exerted by the hose assembly are transferred onto the chassis is achieved in a constructionally simple manner. Moreover, because of the lowered position of the outlet end of the conduit to which the hose assembly is to be connected, when in operation, only a relatively short portion of the hose assembly extends from the floor to the conduit, so that relatively little weight of the hose assembly is carried by the conduit. Accordingly, the contribution of the weight of the hose assembly portion carried by the conduit to any tilting moment causing unloading of the wheels on the side of the cleaning head facing away from the conduit is kept relatively small.

The conduit is preferably a substantially rigid structure, so that so that, in operation, the outlet end is maintained at a relatively constant level closely above the floor independently of the loads to which it is subjected in practice.

If the elbow section is suspended swivably relative to the chassis about a swivel axis perpendicular to the pivot axis and extending spaced below the downstream end of the elbow section, as long as the conduit is in the range in which it is freely swivable, apart from a slight moment due to frictional resistance, no moment about the swivel axis can be transferred from the conduit to the cleaning head. Accordingly, the line of action along which a tension force exerted by the hose assembly is transferred onto the cleaning head will intersect the swivel axis spaced below the downstream end of the elbow section.

The swivel axis may be a virtual swivel axis defined by a linkage linking the elbow section to the chassis, such as a linkage including at least two links of at least one four bar linkage including the elbow section and the chassis. If, moreover, for at least one position of the linkage, the swivel axis extends below the chassis, a particularly effective reduction or even elimination of the tilting moment is achieved, because the line of action of the frictional reaction forces between the floor and the cleaning head extends along the floor, i.e. very closely along or even intersecting the swivel axis that determines the line of action along which a tension force exerted by the hose assembly is transferred onto the cleaning head. By, moreover, providing a support member under the outlet end portion of the conduit, for supporting the conduit relative to the floor surface, the swivability in operation of the conduit relative to the chassis may be limited. This is advantageous for keeping the conduit from reaching a limit of its range of swivability about the swivel axis, thereby preventing the transfer of any significant moment about the swivel axis from the conduit to the chassis.

By providing that the pivot axis extends closely adjacent to an axis of rotation about which the chassis rotates when changing its direction of displacement over the floor surface, it is achieved that the forces exerted upon the cleaning head by the hose assembly have little or no influence on the driving direction of the cleaning head.

A particularly important improvement of the steerability may be achieved in a cleaning head in which the drive system includes at least two circulatable members for displacing the cleaning head in a driving direction when driven to circulate in unison, the at least two circulatable members being spaced apart transversally to the driving direction to the right and to the left of a central plane of the chassis oriented in the driving direction, the drive system further being controllable for driving the circulatable members at different selectable velocities of circulation for steering the cleaning head. More in particular it is then counteracted that, the wheels on one side are unloaded and the opposite wheels are loaded and a difference in circumferential velocities between the wheels on opposite lateral sides results in slip of the unloaded wheels and no or only a limited steering effect.

If the inlet end of the conduit is facing upwardly and the pivotable conduit connects from underneath to an air duct portion communicating with the nozzle, the pivotable conduit can connect pivotably to the non pivotable air duct communicating with the nozzle at a low level so as to keep moments in a vertical plane transferred through the pivotable connection low. Moreover, the elbow section can be connected swivably to the chassis in a simple manner by means of a linkage positioned between the conduit and the chassis.

Further aspects, effects and details of the invention are set forth in the detailed description with reference to examples of which some are shown in the drawings.

DETAILED DESCRIPTION OF THE EMBODIMENTS

Figure 1:
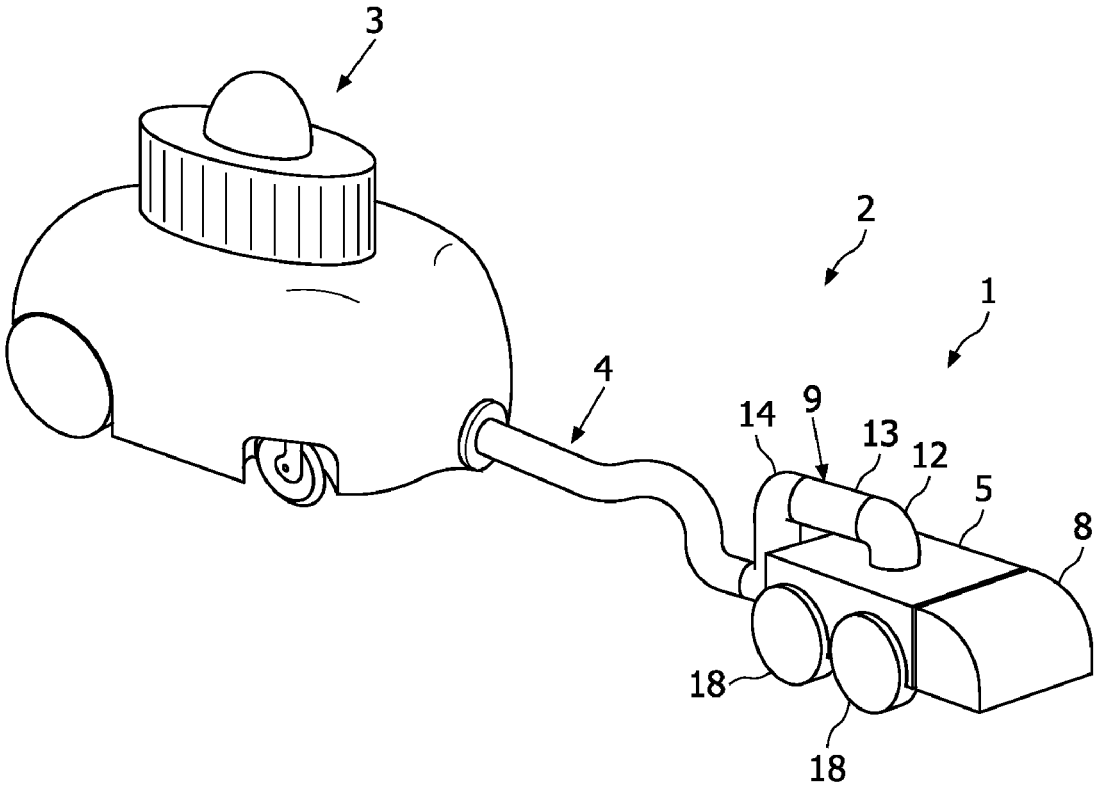
FIG. 1 is a perspective view of an autonomous vacuum cleaning system comprising a cleaning head according to the invention.

In FIG. 1, an autonomous vacuum cleaning system 2 composed of a canister unit 3, a robotic cleaning head 1 and a hose assembly 4 interconnecting the canister unit 3 and the robotic cleaning head 1 is shown.

According to the present example, the canister unit 3 is self-propelled and self-steering and includes a drive system, a canister, a power supply and an electric fan for generating suction power. The drive system of the canister unit 3 has two driven wheels located at the back corners (only one is visible in the figure) and two castors located near the hose connection at the front of the canister unit (only one is visible in the figure).

The cleaning head 1 (shown in more detail in FIGS. 2 and 3) is also self-propelled and self-steering by means of a drive system including a control system 6, a drive assembly 27 and wheels 18. The vacuum hose assembly 4 communicates with a cleaning nozzle 8 of the cleaning head 1 so that the vacuum generated by the canister unit is made available at an inlet of the nozzle 8. The cleaning head 1 is more agile than the canister unit 3 and capable of passing under most objects, such as furniture or radiators. The canister unit 3 is moreover equipped with sensors for providing information about the surroundings and a control unit for using the information provided by the sensors to plan routes for the canister 3 and the cleaning head 1 and to conduct the canister 3 and the cleaning head 1 along these routes. In operation, the cleaning head 1 is more mobile than the canister unit 3, which is controlled to stay within reach of the cleaning head 1 that moves over the floor in accordance with a vacuum-cleaning pattern. The reach is determined by the length and movability of the hose assembly 4. It is also possible to provide that only the cleaning head 1 is equipped with a drive system and tows the canister unit 3 along via the hose assembly 4.

The power supply of the autonomous vacuum cleaning system may be provided in the form of rechargeable batteries, fuel cells, or other self-contained sources of power, or via a connection to a domestic power network.

The drive assembly 27 of the cleaning head 1 includes a motor (not shown) coupled to the wheels 18 via a transmission, clutches and brakes for selectively driving and braking the wheels 18 under control of the control system 6. The four driven wheels 18 of the drive system of the cleaning head 1 drive displacement of the cleaning head 1 in a driving direction (arrow 29) when driven to circulate in unison. The wheels 18 of the drive system are spaced apart transversally to the driving direction to the right and to the left of a central plane 28 of the chassis 5 oriented in the driving direction 29 of the chassis 5. The drive assembly 27 is controllable for driving the wheels 18 at different velocities for steering the cleaning head 1. Changing the driving direction 29 can be achieved by rotating the wheels 18 on opposite sides of the central plane 28 of the chassis 5 at different speeds, by temporarily blocking wheels on one side or even by driving the wheels on opposite sides in opposite senses of rotation.

Instead of or in addition to wheels, the drive system may also include other circulatable members, such as caterpillar tracks. Moreover, instead of all circulatable members, only some of the circulatable members may be driven and/or some may be steerable.

Figure 2:
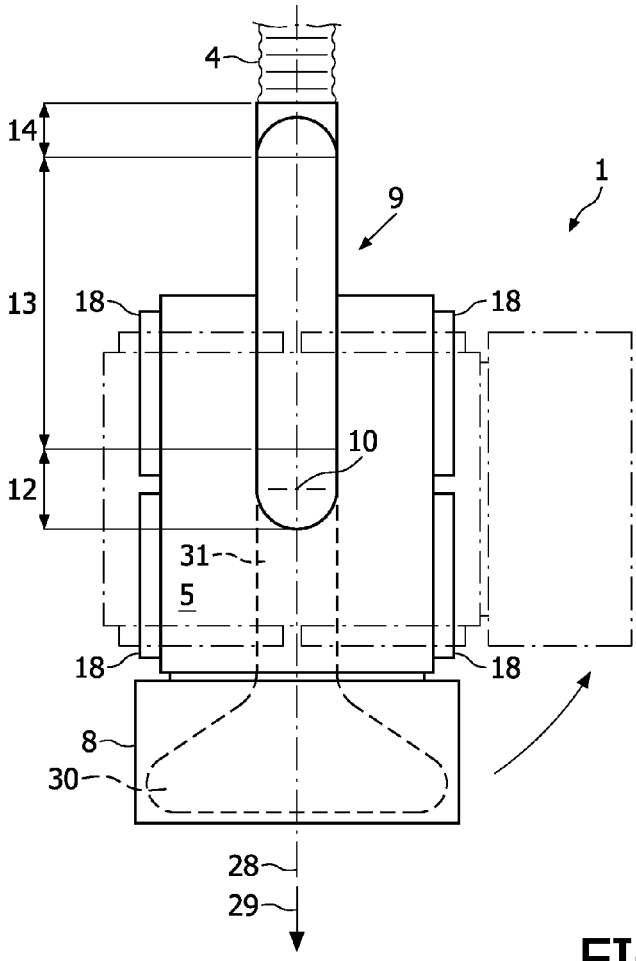
FIG. 2 is a top view of the cleaning head of FIG. 1.

A vacuum-cleaning nozzle 8 is mounted to a front end of the chassis 5 of the cleaning head 1. The nozzle 8 bounds an air passage 30 extending therethrough. A conduit 9 communicates with the cleaning nozzle 8 via an air duct 31 for conducting air received via the air passage 30 to the hose assembly 4. The conduit 9 is suspended pivotably about a generally vertical pivot axis 10 to accommodate for changes in the driving direction 29 of the cleaning head 1 and to changes in the relative position of the cleaning head 1 relative to the canister unit 3 as it drives to and fro while vacuum cleaning a floor surface. The slash-dot lines in FIG. 2 illustrate a different orientation of the chassis 5 and the nozzle 8 relative to the hose assembly 4 obtainable by changing the driving direction 29.

The hose assembly 4 may include wires for providing power to the cleaning head 1 and for communication between the cleaning head and the canister unit 3.

The conduit 9 has an inlet 11 provided on top of the chassis 5, an elbow section 12 downstream of the inlet 11, a boom section 13 extending radially from the elbow section 12 to an outlet end section 14 downstream of the boom section 13. Preferably the inlet is coaxial with the pivot axis 10.

Since the conduit 9 to which the hose assembly 4 is connected is pivotable about a pivot axis 10, it is avoided that the hose assembly 4 exerts a substantial torque about the pivot axis 10 upon the cleaning head 1 and thereby influences the course of travel.

Furthermore, in the present example, the conduit 9 projects horizontally beyond the footprint of the chassis 5 and the drive system 6, 18, and 27 in any of orientation of the conduit 9. This ensures that the conduit 9 and the hose assembly 4 can be pivoted relative to the chassis 5 and the drive system 6, 18, 27 without causing the hose assembly 4 or the conduit 9 to collide with the chassis 5 or the wheels 18 or other parts of the drive system. In the present example, the conduit 9 also projects horizontally beyond the cleaning nozzle 8 when pivoted to an orientation extending over the cleaning nozzle 8, so that the conduit can also pivot to orientations in which it extends forwardly over the cleaning nozzle 8 without causing the hose assembly 4 to hit the cleaning nozzle 8.

The pivot axis 10 is oriented substantially perpendicularly to the floor surface 7 supporting the cleaning head 1 (i.e. substantially vertically when in operation), so that the conduit 9 pivots in a substantially horizontal plane and gravity does not cause the conduit 9 to pivot to a lowermost position.

Furthermore, the pivot axis 10 extends closely adjacent to an axis of rotation of the rotational component of movement when the chassis 5 changes its direction of displacement over the floor surface 7 and is located between the axes of rotation of the wheels 18. Thus, the forces exerted upon the cleaning head 1 by the hose assembly 4 have little or no influence on the driving direction of the cleaning head 1.

Figure 3:
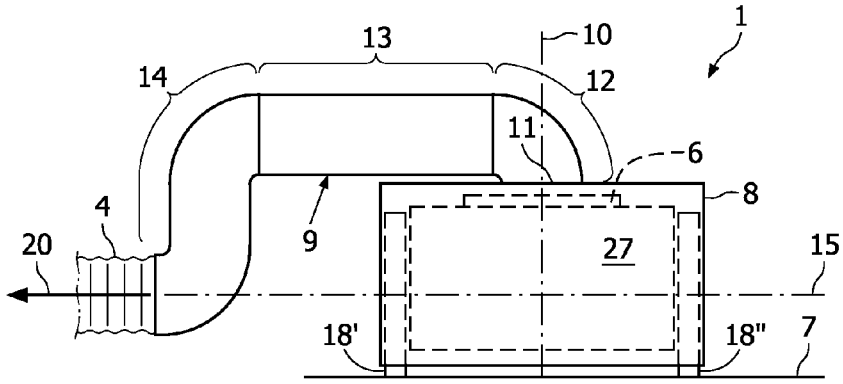
FIG. 3 is a frontal view of the cleaning head of FIG. 1.

As is best seen in FIG. 3, the conduit 9 is suspended and shaped such that, in operating condition, a line of action 15 of a tension force 20 exerted by the hose assembly 4 onto the cleaning head 1 via its conduit 9, extends spaced below a downstream end of the elbow section 12 of the conduit 9.

The tension force 20 exerted upon the cleaning head 1 causes a reaction force in opposite direction in the form of friction between the cleaning head 1 and the floor. The line of action of this friction force is at floor level. Accordingly, the tension force 20 and friction force result in a tilting moment exerted on the cleaning head 1. Because the line of action 15 along which the tension force 20 in the flexible hose assembly 4 is transferred to the cleaning head 1 extends spaced below a downstream end of the elbow section 12 of the conduit 9, this line extends along the positions where the cleaning head 1 contacts the floor 7 at a level lower than the downstream end of the elbow section 12 along which the line of action would extend if the hose assembly would be connected directly to the elbow section 12, as is usual in such pivotable vacuum cleaning hose connections. Due to the lowered location of the line of action 15, the tilting moment caused by the tension force 20 and the friction forces in reaction thereto, is substantially reduced. In turn, this reduced tilting moment results in a reduction of the unloading of the wheels 18" on the side of the cleaning head facing away from the side of the cleaning head 1 to which the conduit 9 is oriented caused by that tilting moment. Accordingly, the adverse effect of such unloading on the steerability of the cleaning head 1 is reduced.

The tilting moment exerted on the cleaning head 1 is especially disadvantageous when the main orientation of the tension force 20 is directed transversely to the driving direction, as is shown in FIG. 3. The different amounts of grip on opposite lateral sides of the cleaning head 1 negatively influence the capability of the drive system to conduct the cleaning head 1 along a pre-defined path of travel, especially on soft floor types like high pole carpet. This is of particular importance if, as in the present example, steering to another driving direction is accomplished by selectively causing the wheels 18' on one lateral side of the cleaning head 1 to rotate at a different velocity than the wheels 18" on the other lateral side of the cleaning head 1. When for instance the wheels 18" on one side are unloaded and the wheels 18' on the opposite side are loaded, a difference in circumferential velocities between the wheels on opposite lateral sides would tend to result in slip of the unloaded wheels 18" and no or only a limited steering effect.

A similar disadvantageous effect of unloading on one lateral side and loading on the opposite lateral side due to a tilting moment would also occur if other circulatable members than wheels, such as caterpillar tracks, are provided.

However, also if steering is to be accomplished by changing the orientation of steering wheels or other circulatable members, lateral loading and unloading negatively affects steering accuracy if obstacles such as a doorstep, a carpet edge or a power cord lying on the floor need to be passed. Moreover, in particular in such cleaning heads, forward or backward loading and unloading, causing the front to be loaded and the rear to be unloaded or vice versa, negatively affects steering accuracy, because the rear or front of the cleaning head can then slip sideways relatively easily.

In the example shown in FIG. 3, the conduit 9 includes an outlet end section 14 downstream of the boom section 13 and at least partially extending horizontally outside of the chassis 5 and the drive system 6, 18, 27 and downwardly from the boom section 13. When in operating condition, a lowermost portion of the outlet end portion 14 is at a level below uppermost portions of the chassis 5, the drive system 6, 18, 27 and the cleaning nozzle 8. Thus, the lowering of the line of action 15 along which the tension forces 20 in the hose assembly 4 are transferred onto the cleaning head 1 is achieved in a constructionally simple manner.

Moreover, since the hose assembly 4 connects to the conduit 9 closely above the floor 7, only a relatively short portion of the hose assembly 4 extends from the floor 7 to the conduit 9, so that relatively little weight of the hose assembly 4 is carried by the conduit 9. Accordingly, the contribution of hose assembly weight to the (undesired) tilting moment unloading the wheels 18" on the side of the cleaning head 1 facing away from the conduit 9 caused by the weight of the hose assembly portion carried by the conduit 9 is relatively small.

The conduit 9 is a relatively rigid structure, for instance substantially more rigid than the vacuum cleaning hose 4, so that, in operation, the outlet end 14 is maintained at a relatively constant level closely above the floor 7 independently of the loads to which it is subjected in practice. Because, moreover, the conduit 9 is pivotable about the pivot axis 10 only, a counter moment contrary to the tilting moment, which counter moment is exerted by outlet end section 14 onto the boom section 13 of the conduit 9 when tension force in the hose assembly is transferred via the outlet end section 14, is effectively transferred from the conduit 9 to the chassis 5, thereby causing the lowered effective position of the line of action 15.

Figure 4:
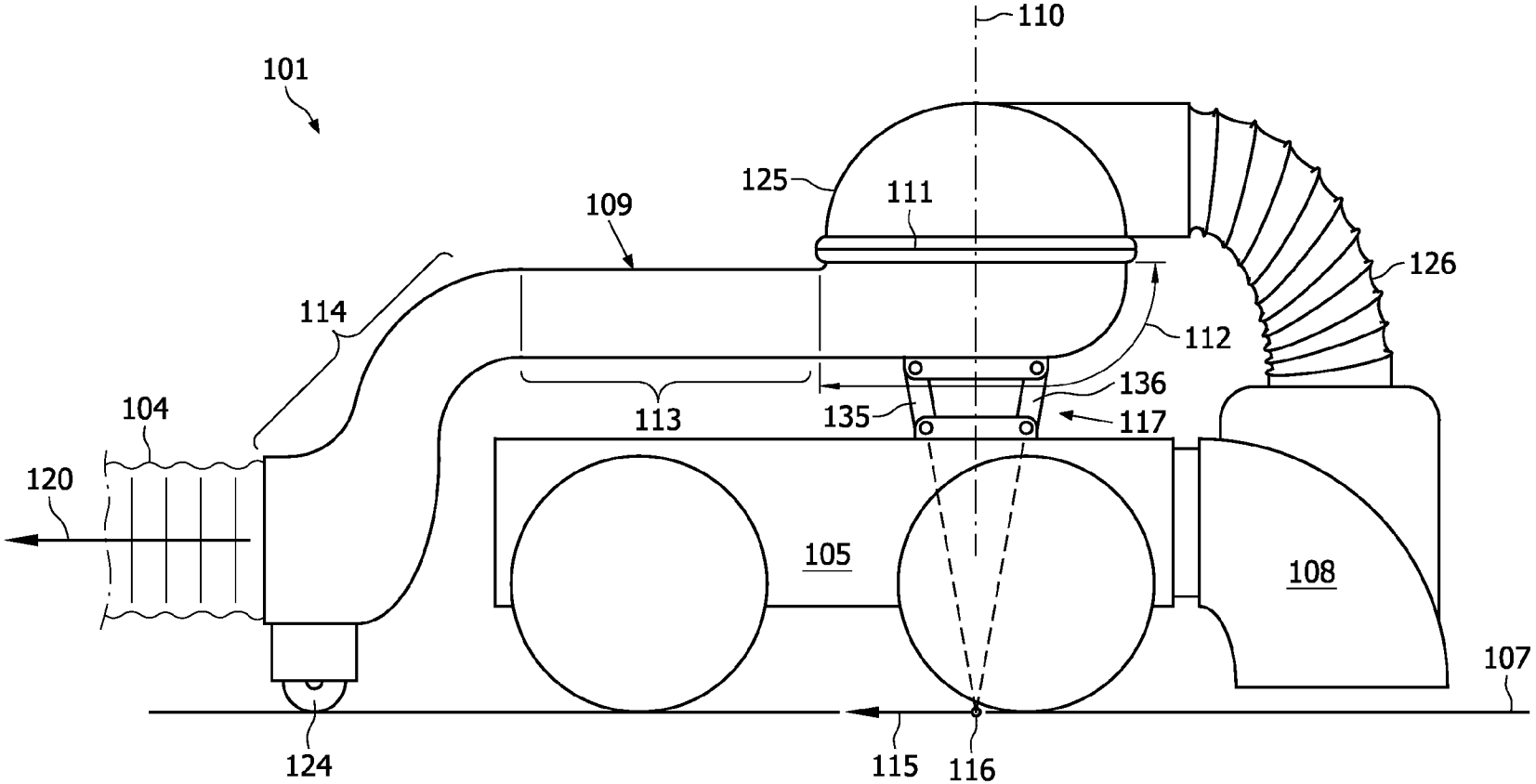
FIG. 4 is a side view of an alternative embodiment of a cleaning head according to the invention.

In FIG. 4, an alternative example of a cleaning head 101 according to the invention is shown, in which the elbow section 112 is suspended swivably relative to the chassis 105 about swivel axis 116 generally perpendicular to the pivot axis 110 and extending spaced below the downstream end of the elbow section 112 in a direction transverse to the line of action 115. A boom section 113 extends radially relative to the pivot axis 110 and transverse to the swivel axis 116 between the elbow section 112 and an outlet end section 114 downstream of the boom section 113.

Because, in operation, the conduit 109 is swivable relative to the chassis about swivel axis 116 that is oriented a generally horizontal and transverse to the line of action 115 of the forces exerted by the hose assembly 104 onto the chassis 105, as long as the conduit 9 is in the range in which it is freely swivable, apart from a slight moment due to frictional resistance, no moment about the swivel axis 116 can be transferred from the conduit 109 to the cleaning head 101. Accordingly, the line of action 115 along which a tension force 120 exerted by the hose assembly 104 is transferred onto the cleaning head 101 will intersect the swivel axis 116 spaced below the downstream end of the elbow section 112.

Preferably, the suspension of the conduit 109 is connected thereto and coupled to the chassis 105 such that the swivel axis 116 can pivot together with the conduit 109, so that the swivel axis 116 remains substantially perpendicular to the line of action 115 if the conduit 109 is pivoted.

Furthermore, due to the swivability of the conduit 109, also the carried weight of the portion of the hose assembly 104 that is free from the floor 107 will not result in a tilting moment exerted onto the chassis 105.

According to the present example, the swivel axis 116 is a virtual swivel axis defined by the structure 117 linking the elbow section 112 to the chassis 105. The virtual swivel axis 116 extends below the chassis 105 and coincides with the floor surface 107, so that the line of action 115 along which tension forces exerted by the hose assembly are transferred onto the cleaning head 101 extends along the floor 107. Since the line of action of the frictional reaction forces between the floor 107 and the cleaning head 1 also extend along the floor 107 no significant tilting moment is caused. It is preferred that the swivel axis is closer to the floor than 2 cm and more preferably closer to the floor than 1 cm.

In the present example, the structure linking the elbow section 112 to the chassis 105 including two pairs 135, 136 of links of four bar linkage, the other pairs of the bars being formed by the elbow section 112 and the chassis 105. Also other linkages, such as a dome shaped sliding or ball bearing mechanism are conceivable.

To the outlet end portion 114 of the conduit 109, a castor wheel 124 for supporting the conduit 109 relative to the floor surface 107 is mounted, minimizing friction between the conduit 109 and the floor surface 107. The support provided by the castor wheel 124 limits the swivability in operation of the conduit 109 relative to the chassis 105 and accordingly the swivel range of the structure 117. This is advantageous for keeping the conduit 9 from reaching a limit of its range of swivability about the swivel axis, thereby preventing the transfer of a moment about the swivel axis 116 from the conduit 109 to the chassis 105. Alternatively, instead of by the wheel 124, the support may also be provided in other forms, such as in the form of a slider and the support may also be mounted to the hose assembly, preferably closely adjacent to the conduit.

The inlet end 111 of the conduit 109 is facing upwardly and the pivotable conduit 109 connects from underneath to an air duct portion 125 communicating with the nozzle 108. This allows the pivotable conduit 109 to connect pivotably to the non pivotable air duct 125 communicating with the nozzle 108 at a low level so as to keep moments in a vertical plane transferred through the pivotable connection low. Moreover, this feature allows to swivably connect the elbow section 112 to the chassis 105 in a simple manner by means of a linkage 117 positioned between the conduit 109 and the chassis 105. A flexible hose 126 interconnects the air duct portion 125 to which the conduit 109 is connected and the nozzle 108 and provides the connection between the swivable air duct portion 125 and the stationary nozzle 108.

A robotic cleaning head for use as part of an autonomous vacuum cleaning system including a canister unit and a hose assembly connecting the cleaning head to the canister unit. The cleaning head has a chassis, a drive system, a vacuum cleaning nozzle and a conduit. The conduit communicates with an air passage bound by the cleaning nozzle. It is suspended pivotable about a pivot axis and includes an inlet provided on top of said chassis, and an elbow section downstream of the inlet, and the conduit is suspended and shaped such that a line of action of a tension force exerted by the hose assembly onto the chassis, via the conduit to which the hose assembly is connected, extends spaced below a downstream end of the elbow section.

From the foregoing, it will be clear to the skilled person, that within the framework of invention as set forth in the claims also many variations other than the examples described above are conceivable. For instance, it is possible to use a cleaning head according to the invention in combination with a stationary canister. Such a stationary canister may be connected via a network of wall, floor and/or ceiling mounted air ducts with for example wall mounted inlets in rooms within a building. The cleaning head can be connected via a relatively long vacuum cleaning hose to once of the wall-mounted inlets. Preferably, the hose is long enough to enable the cleaning head to autonomously clean for example at least a substantial part of a room.

Furthermore, the conduit may be composed out of several parts, for example, the elbow section, the boom section and the outlet section being separate tubular elements assembled to form the conduit. Alternatively the conduit can for example be formed via bending a single tube element.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A robotic cleaning head for use as part of an autonomous vacuum cleaning system (2) further including a canister unit (3) and a hose assembly (4; 104) connecting the cleaning head (1; 101) to the canister unit (3), said cleaning head (1; 101) comprising:

a chassis (5; 105);

a drive system (6; 18; 27) for driving and steering displacement of the cleaning head (1; 101) over a floor surface (7; 107);

a vacuum cleaning nozzle (8; 108) bounding an air passage (30); and a conduit (9; 109) communicating with the cleaning nozzle (8; 108) for conducting air received via said air passage (30) to the hose assembly (4; 104); wherein the conduit (9; 109) is pivotable relative to the chassis about a pivot axis (10; 110);

the conduit (9; 109) includes an inlet (11; 111) provided on top of said chassis (5; 105), and an elbow section (12; 112) downstream of the inlet (11; 111); and the conduit (9; 109) is suspended relative to the chassis and shaped such that, in operating condition, a line of action (15; 115) of a tension force exerted by the hose assembly (4; 104) onto the chassis (5; 105) via the conduit (9; 109), extends spaced below a downstream end of said elbow section (12; 112).

2. A cleaning head according to claim 1, wherein the conduit (9; 109) includes, a boom section (13; 113) extending from the elbow section (12; 112) radially relative to the pivot axis and an outlet end section (14; 114) downstream of the boom section (13; 113) and at least partially extending horizontally outside of the chassis (5; 105) and the drive system (6; 18; 27) and downwardly from the boom section (13; 113), such that, when in operating condition, a lowermost portion of the outlet end portion (14; 114) is at a level below an uppermost portion of at least the chassis (5; 105), the drive system (6; 18; 27) or the nozzle (8; 108).

3. A cleaning head according to claim 1, wherein the conduit (9; 109) is a substantially rigid structure.

4. A cleaning head according to claim 1, wherein the elbow section (112) is suspended swivably relative to the chassis (105) about a swivel axis (116) perpendicular to the pivot axis (110) and extending spaced below the downstream end of said elbow section (112).

5. A cleaning head according to claim 4, wherein the swivel axis (116) is a virtual swivel axis defined by a linkage (117) linking the elbow section to the chassis.

6. A cleaning head according to claim 5, wherein the linkage (117) includes at least two links (135; 136) of at least one four bar linkage including the elbow section (112) and the chassis (105).

7. A cleaning head according to claim 5, wherein, for at least one position of the linkage (117), the swivel axis (116) extends below the chassis (105).

8. A cleaning head according to claim 1, further comprising a support member (124) under the outlet end portion (114) of the conduit (109) for supporting the conduit (109) relative to the floor surface (107).

9. A cleaning head according to claim 1, wherein said pivot axis (10; 110) extends closely adjacent to an axis of rotation about which the chassis (5; 105) rotates when changing its direction of displacement over the floor surface (7; 107).

10. A cleaning head according to claim 1, wherein the drive system (6; 18; 27) includes at least two circulatable members (18) for displacing the cleaning head (1; 101) in a driving direction (29) when driven to circulate in unison, the at least two circulatable members (18) being spaced apart transversally to the driving direction (29) to the right and to the left of a central plane of the chassis (5; 105) oriented in the driving direction (29), the drive system (6; 18; 27) further being controllable for driving the circulatable members (18) at different velocities of circulation for steering the cleaning head (1; 101).

11. A cleaning head according to claim 1, wherein the inlet end (111) of the conduit (109) is facing upwardly and wherein the pivotable conduit (109) connects from underneath to an air duct portion (125) communicating with the nozzle (108).

12. An autonomous vacuum cleaning system comprising a cleaning head (1; 101)acording to claim 1 and further including a canister unit (3) and a hose assembly (4; 104) for connecting the cleaning head (1; 101) to the canister unit (3).

* * * * *